United States Patent [19]

Valente et al.

[11] Patent Number: 5,063,697

[45] Date of Patent: Nov. 12, 1991

[54] SMOOTHING IRON WITH A DEMINERALIZING CARTRIDGE

[75] Inventors: Daniel Valente, Vienne; Jean L. Branrolini, Saint-Etienne; Frederic Volle, Lyon, all of France

[73] Assignee: SEB S.A., Selongey, France

[21] Appl. No.: 535,461

[22] Filed: Jun. 8, 1990

[30] Foreign Application Priority Data

Jun. 8, 1989 [FR] France ..... 8907580

[51] Int. Cl.[5] ..... D06F 75/18; C02F 5/00

[52] U.S. Cl. ..... 38/75; 38/77.8; 38/94; 38/88; 210/94; 210/282

[58] Field of Search ..... 38/3, 14, 74, 75, 77.1, 38/77.83, 88, 89; 210/94, 282

[56] References Cited

U.S. PATENT DOCUMENTS

| | | | |
|---|---|---|---|
| 2,749,307 | 6/1956 | Ellison | 210/94 |
| 4,565,019 | 1/1986 | Cavalli | 38/77.6 |
| 4,657,672 | 4/1987 | Allen | 210/94 |
| 4,740,296 | 4/1988 | Roman | 210/94 |
| 4,893,422 | 1/1990 | Mahlich et al. | 38/77.8 X |
| 4,927,533 | 5/1990 | Takase et al. | 210/282 X |
| 4,969,393 | 11/1990 | Mahlick et al. | 38/77.8 X |

FOREIGN PATENT DOCUMENTS

| | | |
|---|---|---|
| 0306623 | 3/1989 | European Pat. Off. . |
| 2242402 | 3/1974 | Fed. Rep. of Germany . |
| 3014493 | 10/1981 | Fed. Rep. of Germany . |
| 3033964 | 4/1982 | Fed. Rep. of Germany . |
| 3204796 | 9/1982 | Fed. Rep. of Germany . |
| 60-160997 | 8/1985 | Japan . |
| 1014399 | 12/1965 | United Kingdom . |
| 1022697 | 3/1966 | United Kingdom . |

*Primary Examiner*—Werner H. Schroeder
*Assistant Examiner*—Ismael Izaguirre
*Attorney, Agent, or Firm*—Finnegan, Henderson, Farabow, Garrett & Dunner

[57] ABSTRACT

A steam smoothing iron having a removable cartridge (1) which contains a product for demineralizing the water intended to be introduced into the vaporization chamber (2) of the iron. The cartridge (1) is arranged between the water outlet (3) of the water storage container (4) of the iron and the vaporization chamber (2).

15 Claims, 2 Drawing Sheets

SMOOTHING IRON WITH A DEMINERALIZING CARTRIDGE

BACKGROUND OF THE INVENTION

1. Field of the Invention

The present invention relates to a smoothing iron comprising a cartridge which contains a product for demineralizing the water intended to be introduced into the vaporization chamber of the iron.

2. Description of the Related Art

It is known that the water introduced into the water storage container of a smoothing iron must be demineralized to avoid the deposition of inorganic matter, especially of limestone in the vaporization chamber of the iron, which can lead to the obstruction of the steam outlet openings made in the soleplate of the iron.

To prevent this deposition, the users employ either demineralized water sold commercially at a relatively high price, or a cartridge containing a demineralizing substance consisting of particles of ion exchange resin through which the users pass the tap water before introducing it into the water storage container.

At one of their ends, these cartridges comprise a terminal fitting which the user introduces into the water inlet opening of the iron's storage container.

The ion exchange resin contained in these cartridges changes color when it is no longer capable of retaining the limestone in the water, and this shows the user that it should be thrown away.

These cartridges are tedious to use. In fact, filling the water storage container by means of these cartridges is long because they allow only a low flow rate of water, and this is, furthermore, indispensable for demineralizing water efficiently.

EP-A-0,306,623 discloses a steam smoothing iron comprising a demineralizing cartridge at the outlet of its water storage container.

This cartridge is inserted between the water storage container and the heated soleplate of the iron. This arrangement has the disadvantage of increasing the overall height of the iron and above all of raising the ion exchange resin present in the cartridge to an excessive temperature, with the result that the embodiment described in the above document is not, in fact, operational.

The purpose of the present invention is to overcome this major disadvantage.

SUMMARY OF THE INVENTION

According to the invention, the demineralizing cartridge is situated in a cold region of the iron, away from the latter's heated soleplate.

By virtue of this arrangement, the resin or other demineralizing product of the cartridge does not run the risk of being made ineffective by the heat released by the heated soleplate.

According to a preferred version of the invention, the water storage container extends substantially horizontally above the vaporization chamber and the cartridge is situated at the rear end of the water storage container and is supplied with the water originating from the storage container on one side of the cartridge, with a conduit emerging from another side or from the same side of the cartridge and conveying the demineralized water towards the vaporization chamber.

The cartridge is preferably situated substantially at the same height as the water storage container. This arrangement makes it possible at the same time to distance the cartridge from the hot region of the iron and to minimize the overall height of the iron.

Other special features and advantages of the invention will also come to light in the description below.

BRIEF DESCRIPTION OF THE DRAWINGS

In the attached drawings, which are given by way of examples, no limitation being implied.

DETAILED DESCRIPTION OF THE PREFERRED EMBODIMENTS

Figure 1:
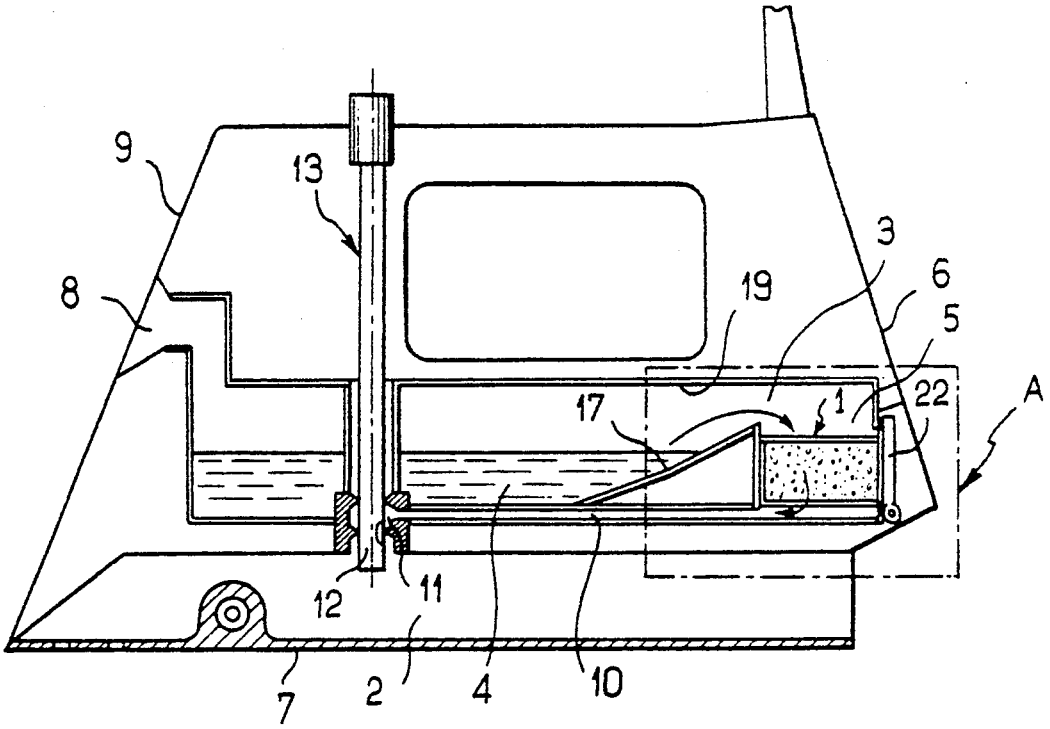
FIG. 1 is a diagrammatic view in lengthwise section of a smoothing iron in accordance with the invention, comprising a demineralizing cartridge.

In the embodiment of the attached figures, the smoothing iron comprises a removable cartridge 1 which contains a product such as an ion exchange resin for demineralizing the water intended to be introduced into the vaporization chamber 2 of the iron.

In accordance with the invention, the cartridge 1 is arranged between the water outlet 3 of the water storage container 4 of the iron and the vaporization chamber 2. This cartridge 1 is not in contact with the heated soleplate 7, but, on the contrary, is away from the latter and is situated in a cold region of the iron.

Furthermore, in the example shown, the cartridge 1 is housed removably at the rear of the iron. It is situated in a housing 5 which opens onto the rear face 6 of the iron.

In the embodiment shown by way of example in FIG. 1 the water storage container 4 lies horizontally above the vaporization chamber 2 and the soleplate 7 of the iron. The water storage container 4 has a water inlet opening 8 which opens onto the front face 9 of the iron. The cartridge 1 is situated substantially at the same height as the storage container 4.

It can be seen that the cartridge 1 is situated at the rear end of the water storage container and is supplied with the water originating from the storage container 4 above the cartridge 1. A conduit 10 emerges below the cartridge 1 and conveys demineralized water towards the vaporization chamber 2, after flowing through the chamber 11, through which passes the needle spigot 12 of the conventional flow rate adjustment system 13, commonly called a "dropper".

Figure 2:
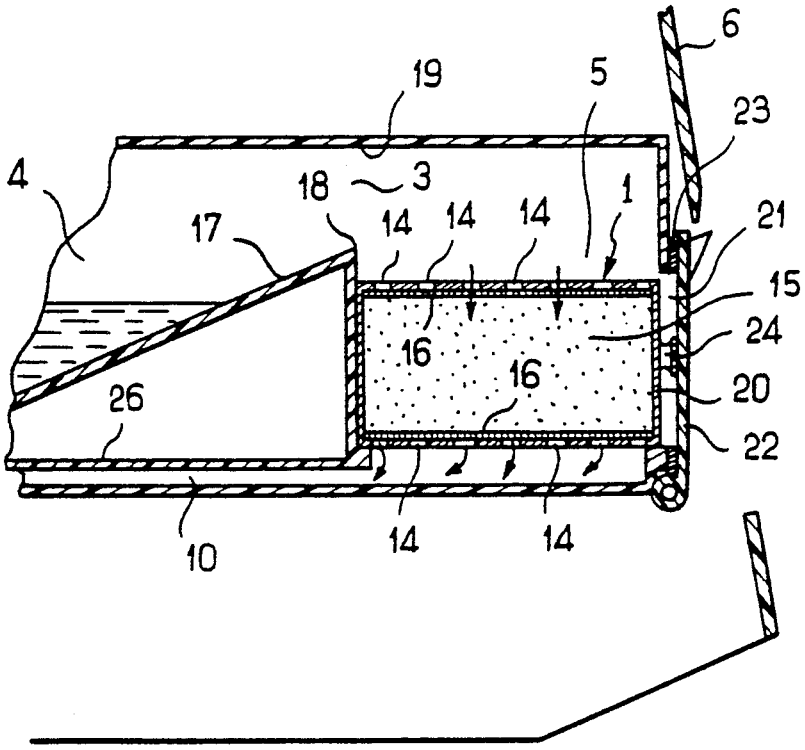
FIG. 2 is a larger scale view of the detail A of FIG. 1.
Figure 3:
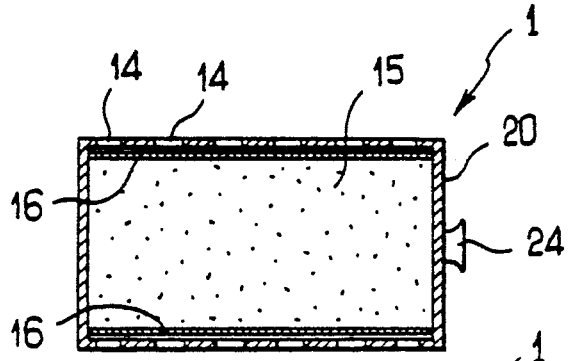
FIG. 3 is a view of the cartridge in lengthwise section.
Figure 4:
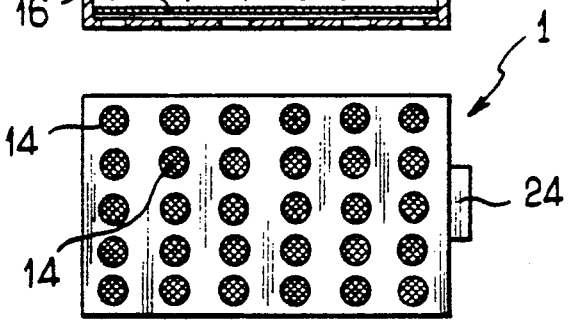
FIG. 4 is a top plan view of the cartridge.

In FIGS. 2 to 4, the walls of the cartridge 1 through which the water enters this cartridge and leaves it, have openings 14. Between these openings 14 and the demineralizing substance 15 present in the cartridge 1 there is arranged a layer 16, permeable to water but preventing the passage of the demineralizing substance, in the form of particles of ion exchange resin.

Furthermore, upstream of the wall through which the water enters the cartridge 1, the water storage container 4 comprises an inclined plane 17 which extends across the whole width of the storage container and whose upper edge 18 is adjacent to the cartridge 1 and is situated slightly above the wall through which the water enters the cartridge. This upper edge 18 defines with the upper wall 19 of the water storage container 4 a passage 3 through which the water can flow from the storage container 4 to the housing 5 containing the cartridge 1, as will be explained in greater detail below.

Furthermore, the wall 20 of the cartridge 1 adjacent to the opening 21 of the housing 5 for this cartridge is transparent, and this makes it possible to observe the color of the ion exchange resin present in the cartridge 1.

Furthermore, the opening 21 of the housing 5 of the cartridge 1 is closed by an articulated shutter 22 which rests on a seal 23 and on a projection 24 arranged on the wall 20 of the cartridge 1, which serves to make it easier to withdraw the latter from the housing 5.

In the example shown, the cartridge 1 is of a parallelepipedal shape. In particular, the water inlet and outlet walls of the cartridge 1 are parallel to the horizontal walls 19 and 26 of the water storage container 4. The water outlet wall of the cartridge 1 is situated slightly above the lower wall 26 of the storage container 4.

As can be seen in FIGS. 1 and 2, the arrangement of the cartridge 1 is such that the latter is located actually inside the storage container 4 and hence practically at the temperature of the water in this storage container. This arrangement makes it possible to prevent the resin present in the cartridge from being exposed to the high heat of the heated soleplate 7 and thus to be effective at all the operating temperatures of the iron.

The operation of the device just described will now be explained.

Before the first use of the smoothing iron the user installs a new demineralizing cartridge 1 in the housing 5.

It is then sufficient for him to fill the storage container 4 with tap water, which he introduces directly via the opening 8.

During the ironing, under the effect of the iron's motion, water rises onto the inclined plane 17 which connects the bottom 26 of the storage container to the housing 5, spills over the edge 18 and enters the cartridge 1, where this water is demineralized.

The demineralized water flows into the conduit 10 extending under the storage container 4 and emerging into the chamber 11 of the needle spigot for adjusting the flow rate. The water then flows dropwise into the vaporization chamber 2, where it does not carry the risk of giving rise to a deposit.

Each time the iron is placed at rest in a vertical position, resting on its rear face 6, also called the heel, the cartridge 1 fills automatically with water.

After the smoothing iron has been used for some time, the ion exchange resin of the cartridge 1 becomes ineffective and changes color. The user can ascertain this color change by opening the shutter 22, through the transparent wall 20 of the cartridge. He can then pull out the latter and replace it with a new cartridge.

The invention is obviously not limited to the example of embodiment just described and many modifications may be made to the latter without departing from the scope of the invention.

Figure 5:
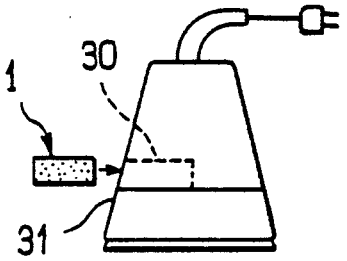
FIG. 5 shows diagrammatically the rear of a smoothing iron receiving a cartridge at the side.
Figure 6:
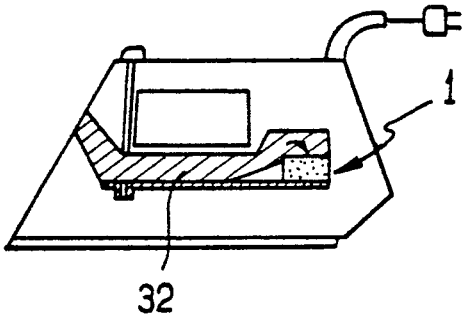
FIG. 6 is a view in lengthwise section of the iron according to FIG. 5.

Thus, in the case of the iron shown in FIGS. 5 and 6, the cartridge 1 is situated in a housing 30 which opens onto a side wall 31 of the iron, and this does not entail any appreciable modification to the storage container 32, which also extends horizontally from the front towards the rear of the iron.

Figure 7:
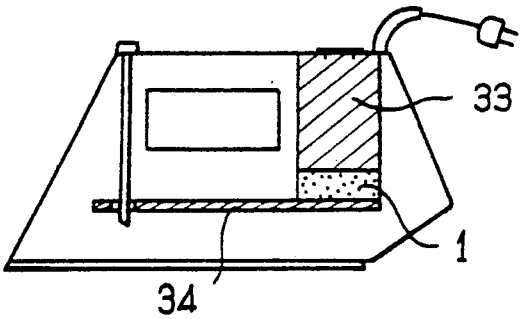
FIG. 7 is a diagrammatic view in lengthwise section of an alternative form of embodiment of a smoothing iron with a water storage container situated at the rear.

In the embodiment of FIG. 7, the water storage container 33 is situated at the rear of the iron and the cartridge 1 is situated removably in a housing situated under the storage container 33.

In this example the cartridge 1 is continually in contact with the water in the storage container 33. Similarly, the conduit 34 extending under the cartridge 1 and conveying demineralized water towards the vaporization chamber is continually filled with water.

Furthermore, the water from the storage container could be delivered at any side of the cartridge and could leave it through another side or on the same side of the latter.

Moreover, the removable and disposable cartridge could be replaced by a fixed housing from which the ion exchange resin could be emptied at regular intervals and which could be refilled with a new resin.

We claim:

1. A smoothing iron comprising:

a heated soleplate;

a vaporization chamber overlying said soleplate;

a water storage container having an outlet; and a cartridge containing material for demineralizing water passed from said outlet to said vaporization chamber, said cartridge being located in a region of the iron substantially isolated from the heat of said soleplate.

2. The smoothing iron recited in claim 1 wherein said water storage container is located above said vaporization chamber, said cartridge being located at the level of said storage container.

3. The smoothing iron recited in claim 2 wherein said water container substantially overlies said vaporization chamber, said cartridge being located to the rear of said storage container.

4. A smoothing iron having a heated soleplate (7), a vaporization chamber (2) overlying the soleplate, a water storage container (4) extending substantially horizontally above the vaporization chamber (2) between front and rear ends and having an outlet (3), a conduit (10) for delivering water to said vaporization chamber, and a cartridge (1) containing a product for demineralizing water introduced into said vaporization chamber from said water outlet, said cartridge being located between said water outlet and said vaporization chamber ,being spaced adequately from said heated soleplate to be located in a relatively cold portion of the iron, and being situated at the rear end of the water storage container (4) to be supplied with water from the storage container and to deliver demineralized water to the conduit (10) for conveying the demineralized water towards the vaporization chamber (2), said cartridge further being situated substantially at the same level as the water storage container (4).

5. A smoothing iron having a heated soleplate (7), a vaporization chamber (2) overlying the soleplate, a water storage container (4) having an outlet (3), a cartridge (1) containing a product for demineralizing water introduced into said vaporization chamber from said water outlet, said cartridge being located between said water outlet and said vaporization chamber and being spaced adequately from said heated soleplate to be located in a relatively cold portion of the iron, said cartridge (1) including walls having openings (14) through which the water enters and exits the cartridge and a layer (16) of material between said openings and the demineralizing substance, said layer being permeable to water but preventing the passage of the said demineralizing substance (15).

6. The smoothing iron in accordance with claim 5, wherein the water storage container (4) comprises an upper wall (19) and an inclined plane (17) having an upper edge (18) adjacent to the cartridge and situated slightly above the the cartridge, the said upper edge (18) defining with the upper wall (19) of the water storage container (4) a passage (3) through which the water can flow from the storage container (4) to the cartridge.

7. A smoothing iron comprising: a water storage container having a water outlet, a heated soleplate, a vaporization chamber, a conduit for conveying water from said storage container to the vaporization chamber, and a cartridge for containing a product for demineralizing water to be introduced into said vaporization chamber, said cartridge being in fluid communication between said water outlet and the vaporization chamber, said water storage container extending substantially horizontally between front and rear ends and at a level above the vaporization chamber, the cartridge being located at the rear end of the water storage container to be supplied with the water from the storage container and to convey demineralized water via said conduit to the vaporization chamber, said cartridge being located at substantially the same height as the water storage container.

8. A smoothing iron in accordance with claim 7, wherein the cartridge includes walls having openings through which the water enters and exits the cartridge, and a layer of material between said openings and the demineralizing substance, said layer being permeable to water but preventing the passage of the said demineralizing substance.

9. A smoothing iron in accordance with claim 7, wherein the iron has front and rear ends, and comprising a housing for said cartridge at said rear end, said cartridge being removably received in said housing.

10. A smoothing iron having front and rear ends and comprising: a water storage container having a water outlet, a heated soleplate, a vaporization chamber, and a conduit for conveying the water of said storage container towards the vaporization chamber, said storage container comprising an upper wall, a bottom container wall having an upwardly inclined portion extending rearwardly to an upper edge, and a housing at the rear end of said bottom container wall, said housing having a bottom housing wall, the upper edge of said inclined portion being located adjacent to the housing and above the bottom housing wall, the upper edge of said inclined portion defining with the upper wall of the water storage container a passage through which the water can flow from the storage container to the housing, said housing communicating with said conduit.

11. A smoothing iron according to claim 10, wherein said housing comprises a cartridge containing a product for demineralizing the water in said storage container, said cartridge being received in said housing so that the water flowing from the storage container passes through said cartridge to be demineralized and the demineralized water enters into said conduit.

12. A smoothing iron in accordance with claim 11, wherein the cartridge includes walls having openings through which the water enters and exits the cartridge, and a layer of material between said openings and the demineralizing substance, said layer being permeable to water but preventing the passage of the said demineralizing substance.

13. A smoothing iron in accordance with claim 11, wherein said cartridge is removably received in said housing.

14. A smoothing iron in accordance with claim 13, wherein said housing has an opening for removing said cartridge from said housing and for reintroducing a new cartridge into said housing.

15. A smoothing iron in accordance with claim 11, wherein said housing is defined in said water storage container.

* * * * *

UNITED STATES PATENT AND TRADEMARK OFFICE

CERTIFICATE OF CORRECTION

PATENT NO. : 5,063,697

DATED : November 12, 1991

INVENTOR(S) : Daniel VALENTE, Jean L. BRANDOLINI, Frederic VOLLE

It is certified that error appears in the above-identified patent and that said Letters Patent is hereby corrected as shown below:

Title page:

[75] Change "Branrolini" to --Brandolini--.

Signed and Sealed this

Fourth Day of May, 1993

*Attest:*

*Attesting Officer*

Michael K. Kirk

MICHAEL K. KIRK

*Acting Commissioner of Patents and Trademarks*